United States Patent [19]

Szahler

[11] 4,437,566

[45] Mar. 20, 1984

[54] CHILD PROOF CONTAINER

[75] Inventor: David J. Szahler, Parma Heights, Ohio

[73] Assignee: A Packaging Service Company, Inc., Valley View, Ohio

[21] Appl. No.: 403,859

[22] Filed: Jul. 30, 1982

[51] Int. Cl.[3] ..... B65D 83/00; B65D 5/38; B65D 85/00

[52] U.S. Cl. ..... 206/1.5; 206/534.1; 206/467; 206/468; 220/306; 229/11; 229/20

[58] Field of Search ..... 206/1.5, 534, 534.1, 206/534.2, 468, 467; 220/8, 306; 229/9, 11, 19, 20

[56] References Cited

U.S. PATENT DOCUMENTS

| | | | |
|---|---|---|---|
| 2,426,856 | 9/1947 | Berg | 206/534.1 |
| 3,568,827 | 3/1971 | Haring | 220/8 |
| 3,812,963 | 5/1974 | Zahuranec et al. | 206/332 |
| 4,007,828 | 2/1977 | Mayled | 206/1.5 |

*Primary Examiner*—William T. Dixson, Jr.
*Attorney, Agent, or Firm*—Fay & Sharpe

[57] ABSTRACT

A child proof container or article dispenser resistant to accidental opening is provided. The container is comprised of an outer housing and a sliding tray or reservoir included in the housing and locking means for locking the tray in a first position in the housing. Guide means control the sliding movement of the tray. The locking means comprises a locking member of the sliding tray disposed for locking reception in a locking member receiving port of the housing upon sliding of the reservoir to the first position. The locking member is resiliently urged towards the receiving port. The receiving port preferably comprises an extended sleeve sized to preclude deflection of the locking member by the finger of a child. Simultaneous deflection of the locking member for the locking member receiving port and operation of a tray handle allows unlocking of the container and movement of the tray to a second position for dispensing of articles contained therein.

9 Claims, 10 Drawing Figures

FIG. 1
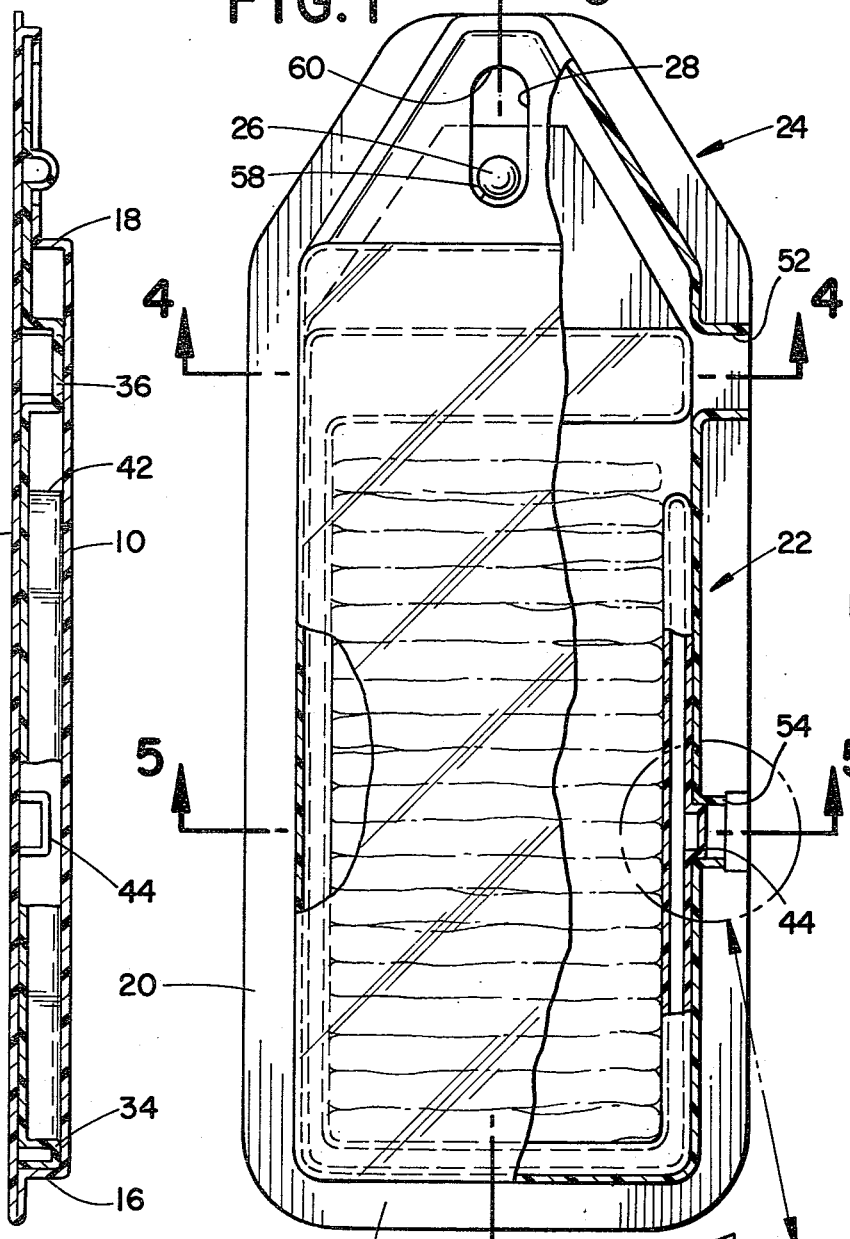
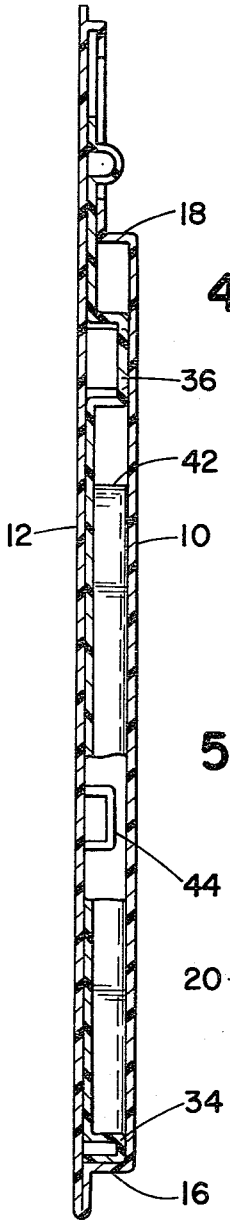
FIG. 3
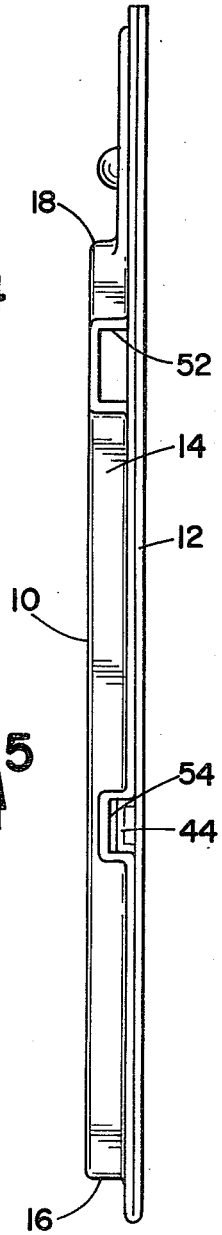
FIG. 2
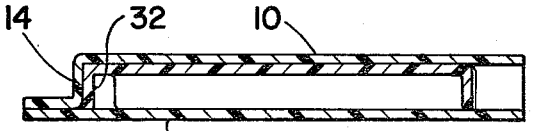
FIG. 4
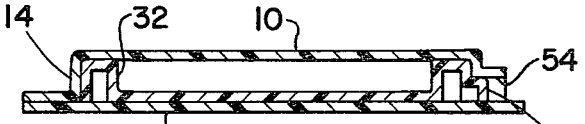
FIG. 5
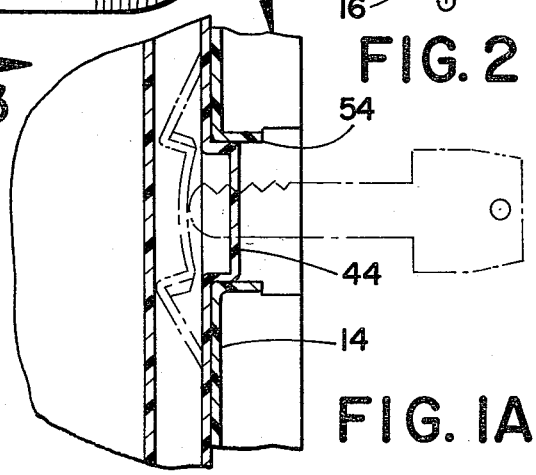
FIG. 1A

CHILD PROOF CONTAINER

BACKGROUND OF THE INVENTION

This invention pertains to the art of packaging devices, product containers or article dispensers and, more particularly, to a packaging device resistant to accidental opening.

The invention is particularly applicable to a container for the packaging and dispensing of potentially harmful or dangerous articles such as insecticides, chemicals or pharmaceuticals. However, it will be appreciated to those skilled in the art that the invention could be readily adapted for use with other items as, for example, where similar packaging devices are employed to protect contained items from accidental opening.

Numerous types of container devices, and particularly child proof container devices, are known in the art. A common type of child proof container is one which includes a twist-off cap that may be operated only upon a force being applied to the container cap normal to the twisting action force and opposite of the direction of removal of the cap from the container, i.e., a push-and-turn operation. One problem with such a container is that oftentimes an excessive and uncomfortable amount of force is required before such a cap may be twisted off. An additional problem is that a cap for such a container is expensive to manufacture. Yet another problem is that such containers are particularly applicable for containing only fluids and capsule-sized and configured items. Long and flat items may not be economically and conveniently stored in such containers.

The present invention contemplates a new and improved container device which overcomes all of the above referred to problems, and others, to provide a new container device which is particularly useful as a child proof container or a container that is resistant to accidental opening. The invention is simple in design, economical to manufacture, readily adaptable as a container for a plurality of size and shape items, easy to operate, and provides improved locking closure operation.

BRIEF SUMMARY OF THE INVENTION

In accordance with the present invention, there is provided a container resistant to accidental opening comprising an outer housing, a sliding inner tray or reservoir, guide means for selectively positioning the reservoir to a first position and a second position; and, locking means for locking the reservoir in the first position. The locking means comprises a locking member included in the inner tray and disposed generally contiguous to a locking member receiving port of the outer housing. The locking member is resiliently urged towards the receiving port for locking reception in the port when the inner tray is at the first position. The housing includes a housing opening disposed for association with a reservoir opening for dispensing of articles upon sliding of the reservoir to the second position.

In accordance with another aspect of the present invention, the locking means comprises a protuberance disposed in a side wall of the reservoir. The protuberance is sized for nesting and locking reception in the locking member receiving port.

In accordance with yet another aspect of the invention, the locking member receiving port comprises an extended sleeve sized to prohibit insertion of a finger.

In accordance with a more limited aspect of the present invention, the locking means comprises a pair of opposed protuberances of the reservoir disposed generally contiguous to an associated pair of opposed locking member receiving ports of the housing.

One benefit obtained by use of the present invention is a child proof container resistant to accidental opening by children.

Another benefit obtained from the present invention is a child proof container including locking means which are simple and easy to unlock.

A further benefit of the present invention is a container resistant to accidental opening that may conveniently contain articles configured in a plurality of different sizes and shapes.

Other benefits and advantages for the subject new child proof container will become apparent to those skilled in the art upon a reading and understanding of this specification.

BRIEF DESCRIPTION OF THE DRAWINGS

The invention may take physical form in certain parts and arrangements of parts, the preferred and alternative embodiments of which will be described in detail in the specification and illustrated in the accompanying drawings which form a part hereof and wherein:

FIG. 1 is a front plan view of the preferred embodiment of the container formed in accordance with the present invention shown partially in section;

FIG. 1A is an enlarged cross-sectional view of a portion of the device of FIG. 1 showing the locking means of the subject invention in selected positions;

FIG. 2 is a side view of the preferred embodiment of the present invention;

FIG. 3 is a cross-sectional view of the device of FIG. 1 taken along line 3—3 of FIG. 1;

FIG. 4 is a cross-sectional view of the device of FIG. 1 taken along line 4—4;

FIG. 5 is a cross-sectional view of the device of FIG. 1 taken along line 5—5;

DETAILED DESCRIPTION OF THE INVENTION

Figure 6:
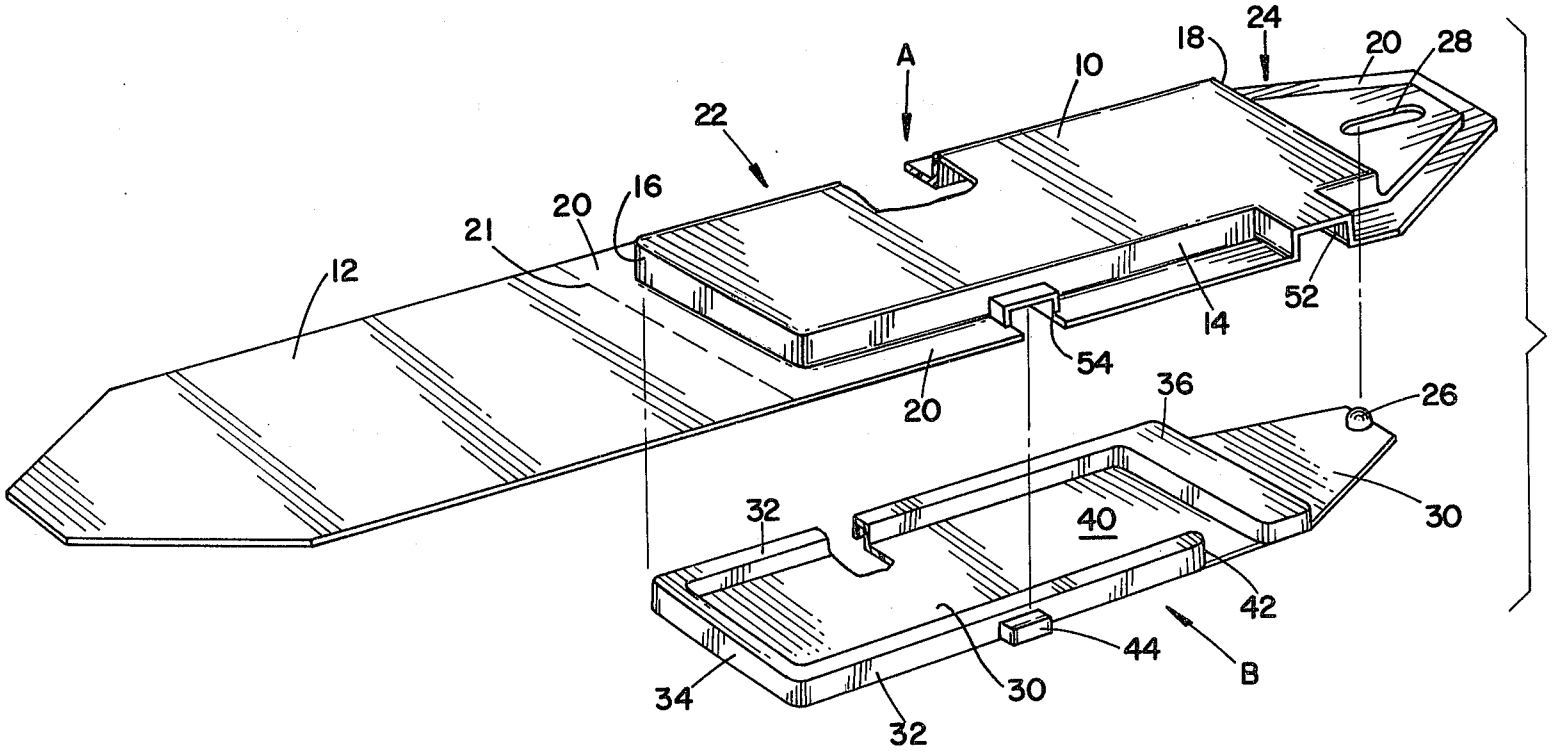
FIG. 6 is a perspective view of the invention of FIG. 1 shown at a pre-assembly position and in partial section for ease of illustration.

Referring now to the drawings wherein the showings are for purposes of illustrating the preferred and alternative embodiments of the invention only and not for purposes of limiting same, the FIGURES show a container or article dispenser comprised of an outer housing A and an inner tray or reservoir B (FIG. 6) and which container or dispenser is particularly resistant to accidental opening by children.

More specifically, and with reference to FIG. 6, outer housing A and inner tray B comprise thermal formings preferably constructed of a plastic material. However, it is within the scope of the invention to construct the container with other types of materials, such as metals, where alternate uses or applications of the invention may suggest or require.

More specifically, and with reference to FIGS. 1 and 2, housing A includes a top wall 10, a bottom wall 12, opposed side walls 14, a one end wall 16 and a second end wall 18. Side walls 14 and end walls 16, 18 depend from the housing top wall 10 and adjacent bottom wall 12 include a peripheral flange 20 for sealing engagement to the bottom wall 12. Flange 20 is preferably welded to the bottom wall 12 by known methods but it is within the scope of the invention to employ alternate sealing or attaching means such as adhesives or the like.

With particular reference to FIG. 6, it may be seen that in one embodiment of the invention, housing A comprises a unitary member produced in a conventional thermal forming manner. Upon reception of inner tray or reservoir B in housing A, bottom wall 12 is folded over tray or reservoir B such that the terminal edge portions of the bottom wall 12 align with flange 20 for sealing engagement between them. A fold line 21 is provided in FIG. 6 for ease of illustration.

Bottom wall 12 is sized for matching alignment with the terminal ends of flange 20. Alternatively though, the size of flange 20 may be determined by die cut after welding of the bottom wall 12 to the flange 20.

With continued reference to FIGS. 1, 2 and 6, container A includes a first container portion 22 and a second container portion 24. First container portion 22 is sized to receive and contain the substantial portion of sliding tray B including that portion of tray B in which contained articles are received, i.e., the reservoir section. Second container portion 24 is sized to receive actuator or guide means including a handle or finger tab 26 for controlling the sliding movement of tray B. Second container portion 24 further includes an aperture or slot 28 through which handle 26 may be conveniently extended.

Inner tray or reservoir B includes a tray bottom wall 30, opposed side walls 32, a tray one end wall 34 and a tray second end wall 36. Side walls 32 may comprise a raised edge portion of bottom wall 30. Tray side walls 32 are disposed for close reception against housing side walls 14 to guide the sliding movement of the tray B in the housing A. Tray one end wall 34 is sized for closed abuttment against housing one end wall 16 upon positioning of the tray B at a first position in the housing A, and tray second end wall 36 is similarly sized for close abuttment to housing second end wall 18 upon positioning of the tray B at a second position in housing A, as will be hereinafter more fully explained. Tray walls 32, 34, 36 are further sized to extend from housing bottom wall 12 to housing top wall 10 (FIG. 3) to define a reservoir section 40 for containment of articles. An interruption 42 in tray side wall 32 is provided for the ingress and egress of articles to the reservoir section 40. A protuberance 44 is included in tray side wall 32 for employment as part of the locking means of the present invention.

Housing A includes an access port 52 generally disposed for alignment with tray wall interruption 42 to provide a passageway through housing side wall 14 and tray side wall 32 to the reservoir section 40. A locking member receiving port 54 is also included in housing side wall 14 generally contiguous to locking member 44 for nesting and locking reception of the locking member 44 in the receiving port 54. Locking member receiving port 54 preferably comprises an extended sleeve sized to prohibit insertion of a child's finger.

Housing second container portion 24 is illustrated as having a generally frustro-conical cross-sectional configuration. Similarly, the associated portion of tray bottom wall 30 is likewise configured. However, it is clearly within the scope of the invention to include alternate configurations where desired.

OPERATION

With particular attention to FIGS. 1 through 5, the improved operational characteristics of the subject invention will be specifically discussed.

The invention has a locking and sealing nature particularly resistant to accidental opening or child tampering that would cause opening. The locking member or protuberance 44 of the inner tray is resiliently urged into the locking member receiving port of the container housing. Such resiliency is effected by employment of a construction material for the tray side wall 32 that will permit slight movement of the protuberance 44 out of the receiving port 54 by a manual force as may be imparted by a key or other tool inserted into the receiving port from outside the housing A (FIG. 1A). As the protuberance 44 is sized for close reception in the receiving port 54, without deflection of the protuberance from the receiving port, tray B is fixed in a locked position in the housing A. During reception of the locking member 44 in the locking member receiving port 54, tray second end wall 36 is positioned adjacent housing access port 52 to preclude the ingress or egress of materials to the tray reservoir section 40. Tray second end wall 36 is sized to substantially seal access port 52 when the sliding tray B is in the first position defined by reception of the locking member 44 in the receiving port 54. The locked position of the invention may be further defined by abuttment of the tray one end wall 34 against the housing one end wall 16 and abuttment of the finger tab 26 against a first stop end 58 of slot 28.

Upon deflection of the locking member 44 out of the locking member receiving port 54, sliding tray B is unlocked and freed to be slid to a second position whereby articles contained in the reservoir section may be inserted or removed through the housing access port 52 and the tray side wall interruption 42. Thus, the tray may be slid to a second position by which access may be had to the reservoir section only upon simultaneous deflection of the locking member 44 and actuation or movement of handle or finger tab 26 to effect sliding movement of the tray. The second position may be further defined by abuttment of tray second end wall 36 against housing second end wall 18 or abutting engagement of finger tab 26 with second stop end 60 of slot 26.

It will be seen by one skilled in the art that the manual dexterity required to employ a tool to unlock the locking means of the invention while simultaneously exerting a pressure force on the finger tab 26 to effect opening of the container is beyond the capability of most children. In addition, such locking means are particularly inhibitive of accidental opening of the container by anyone.

Figure 7:
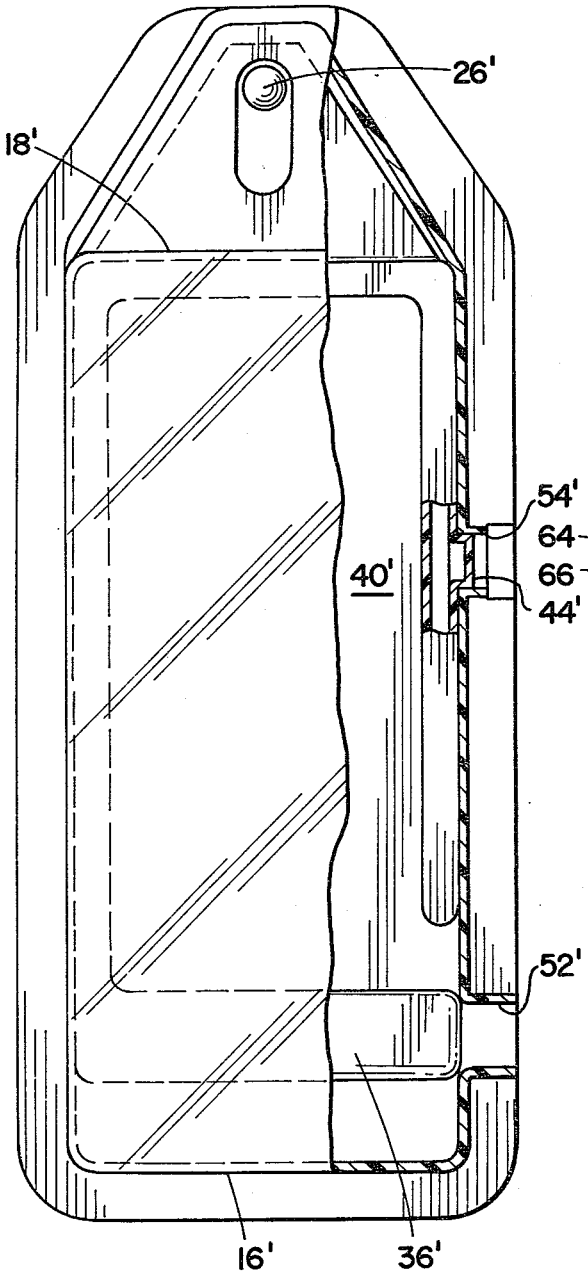
FIG. 7 is a plan view in partial section of a first alternative embodiment of the invention.

With particular attention to FIG. 7, a first alternate embodiment of the invention is there shown. Like components are identified by like numerals with the addition of a primed (') suffix and new components are identified by new numerals. Here, housing access port 52' and locking member receiving port 54' are reversed in the sense that access port 52' is disposed near housing one end wall 16' and receiving port 54' is disposed near housing second end wall 18'. Similarly, locking member 44′ and tray second end wall 36′ are associatively reversed. Such a configuration for the invention is particularly useful where it is advantageous that access port 52′ be disposed near the bottom of the housing A, if, for example, the invention were to be used in a upright manner such that gravitational forces would force the contents received in the reservoir section 40′ towards the tray second end wall 36′. In addition, the alternate embodiment of FIG. 7 includes a locking member receiving port 54′, comprising a sleeve shortened from the extended sleeve of the preferred embodiment of the invention of FIG. 1. The shortened sleeve 54′ of the alternate embodiment allows deflection of locking member 44′ by actual contact of the locking member 44′ by a finger. The difficulty in unlocking the invention is lessened in that a tool is no longer required to effect unlocking of the locking means; however, the requirement of simultaneous deflection of the locking member and operation of the finger tab 26′ similarly operates to inhibit accidental opening of the container.

Figure 8:
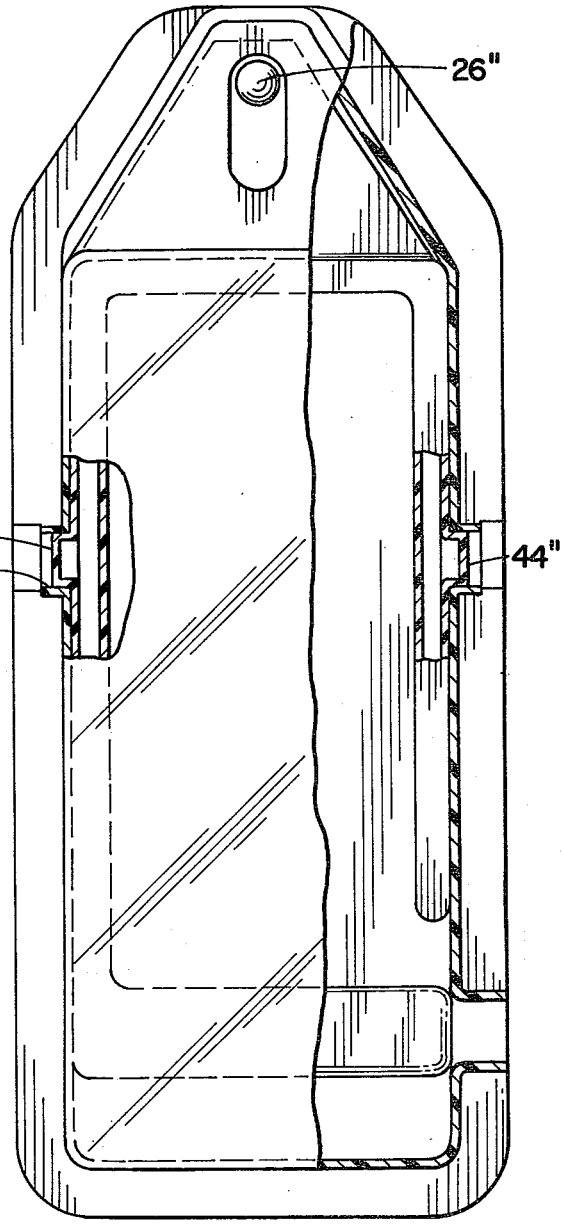
FIG. 8 is a plan view in partial section of a second alternative embodiment of the present invention; and, FIG. 9 is a plan view of the preferred embodiment of the invention mounted upon a backing plate or card.

With particular reference to FIG. 8, a second alternate embodiment of the invention is there shown. Similarly, like components are identified by like numerals with the addition of a double primed (″) suffix and new components are identified by new numerals. The embodiment of FIG. 8 is substantially identical to that of the embodiment of FIG. 7, except that a second locking member 64 is received in a second locking member receiving port 66. Unlocking of the invention requires simultaneous deflection of first locking member 44″, second locking member 64 and exertion of sliding force to the finger tab 26″. A pinching or squeezing action to the pair of locking members 54″, 64 may be advantageously employed by one hand of an individual intending to unlock the device, with operation of the finger tab 26″ by the other hand.

Figure 9:
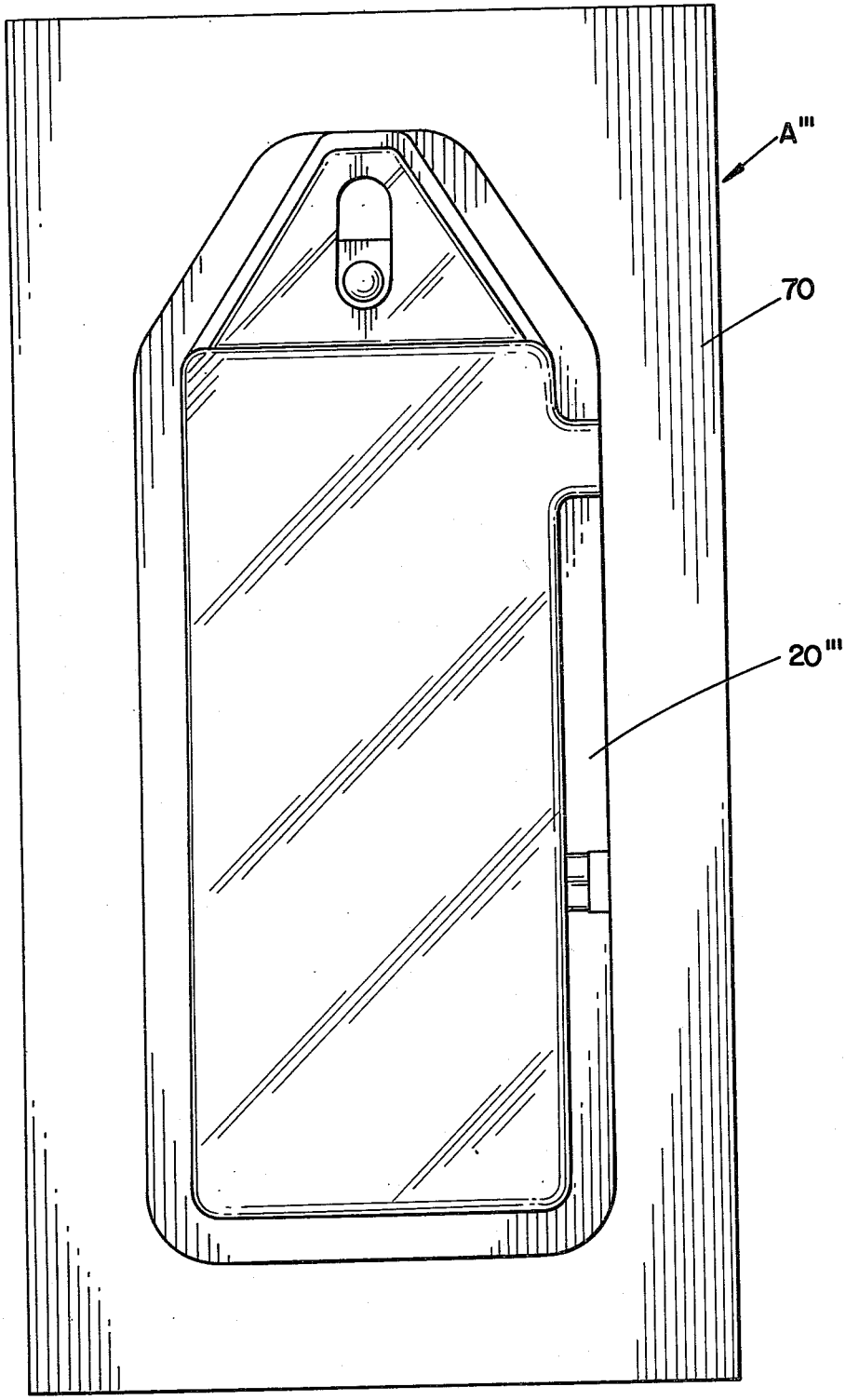

With particular reference to FIG. 9, yet another alternate embodiment of the invention is there shown. Here, a back wall 70 of housing A‴ comprises a backing plate or card substantially larger than the perimeter of the housing flange 20‴. Backing card 70 thereby provides substantial available space for inclusion of descriptive information of the contents of the container and operational instructions for unlocking the container. Backing card 70 may be conventionally attached to flange 20‴ with conventional adhesives or welding techniques.

The invention has been described with reference to the preferred and several alternate embodiments. Obviously, modifications and alterations will occur to others upon the reading and understanding of the specification. It is my intention to include all such modifications and alterations insofar as they come within the scope of the apended claims or the equivalents thereof.

What is claimed is:

1. A container resistant to accidental opening comprising:

an outer housing, an inner tray, actuator means for selectively positioning said inner tray to a first position and a second position; and locking means for locking said tray in said first position;

said locking means including a protruding locking member included in said inner tray disposed generally contiguous to a locking member receiving port of said outer housing comprising an extended sleeve having an extent greater than said protruding locking member to inhibit accidental deflection of said locking member from said sleeve, said locking member being resiliently urged towards said receiving port for close locking reception in said port at said first position.

2. The container as defined in claim 1 wherein said locking means comprises a pair of opposed protuberances of said inner tray being disposed generally contiguous to an associated pair of opposed locking member receiving ports.

3. The container as defined in claim 1 wherein said housing includes an access port and said serving tray includes a side wall and an interruption in said side wall disposed for alignment with said access port upon positioning of said serving tray at said second position.

4. The container as defined in claim 3 wherein a portion of said serving tray side wall is disposed adjacent said access port upon positioning of said serving tray at said first position.

5. The container as defined in claim 1 wherein said actuator means comprises a finger tab in operational engagement to said serving tray extending through an associated slot of said housing.

6. The container as defined in claim 2 wherein said slot includes a first stop end and a second stop end, said first stop end being positioned to define said first position upon abutting engagement with said finger tab, said second stop end being positioned to define said second position upon abutting engagement with said finger tab.

7. An article dispenser comprising a housing, a sliding reservoir including a reservoir opening contained in said housing, guide means for limiting sliding movement of said reservoir and locking means for locking said reservoir in a first position precluding dispensing of articles included in said dispenser;

said housing including a housing opening disposed for association with said reservoir opening for dispensing of articles upon sliding of said reservoir to a second position;

said locking means comprising a locking member of said reservoir disposed for locking reception in a locking member receiving port of said housing upon sliding of said reservoir to said first position;

said guide means and said locking means being disposed for simultaneous operative cooperation for sliding of said reservoir from said first position to said second position whereby said article dispenser is resistant to accidental opening by children.

8. The article dispenser as defined in claim 7 wherein said guide means comprises a handle fixed to said reservoir and extending through said housing.

9. The article dispenser as defined in claim 8 wherein said guide means further includes side walls of said reservoir in close reception to side walls of said housing.

* * * * *